United States Patent [19]

Dille et al.

[11] Patent Number: 4,466,810

[45] Date of Patent: Aug. 21, 1984

[54] PARTIAL OXIDATION PROCESS

[75] Inventors: Roger M. Dille, Port Arthur, Tex.; George N. Richter, San Marino; Lawrence E. Estabrook, Whittier, both of Calif.; Jean-Georges P. Rohner, Zurich, Switzerland; Harold A. Rhodes, Beaumont, Tex.

[73] Assignee: Texaco Inc., White Plains, N.Y.

[21] Appl. No.: 445,388

[22] Filed: Nov. 29, 1982

[51] Int. Cl.[3] ..... C10J 3/46

[52] U.S. Cl. ..... 48/197 R; 48/206; 48/212; 48/215; 252/373

[58] Field of Search ..... 48/197 R, 206, 215, 48/210, DIG. 7, 212; 252/373; 210/634

[56] References Cited

U.S. PATENT DOCUMENTS

| | | | |
|---|---|---|---|
| 4,141,695 | 2/1979 | Marion et al. | 252/373 |
| 4,205,962 | 6/1980 | Marion et al. | 252/373 |
| 4,315,834 | 2/1982 | Von Derverschot | 48/215 |

*Primary Examiner*—Peter F. Kratz

*Attorney, Agent, or Firm*—Robert A. Kulason; Robert Knox, Jr.; Albert Brent

[57] ABSTRACT

A continuous process for preventing the build-up of metals from the hydrocarbonaceous fuel feed in a partial oxidation system in which about 80–100 wt. % of the carbon-soot produced is recycled to the gas generator. By the subject process a significantly large portion of the metals and metal compounds i.e. ash in the soot-water feed stream to the decanter become concentrated in the grey water that separates out in the decanter in the carbon recovery section. The concentration of ash suspended in the grey water may be then easily reduced in a solids-liquid separator with or without the addition of a flocculant and prior to recycling a portion of the grey water to the gas quench tank and/or gas scrubber. Further, the ash suspended in the carbon-soot-liquid hydrocarbonaceous fuel stream from the bottom of the liquid organic extractant still may be optionally reduced in another solids-liquid separator prior to recycling a portion of said stream to the gas generator as part of the hydrocarbonaceous reactant fuel feed.

22 Claims, 1 Drawing Figure

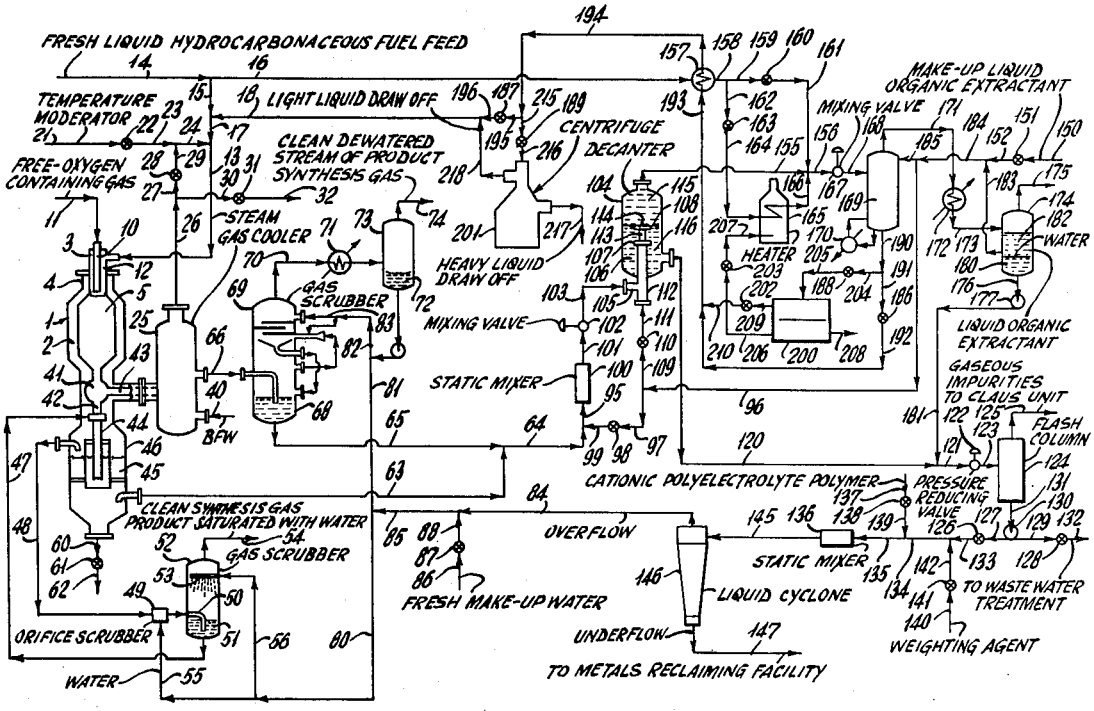

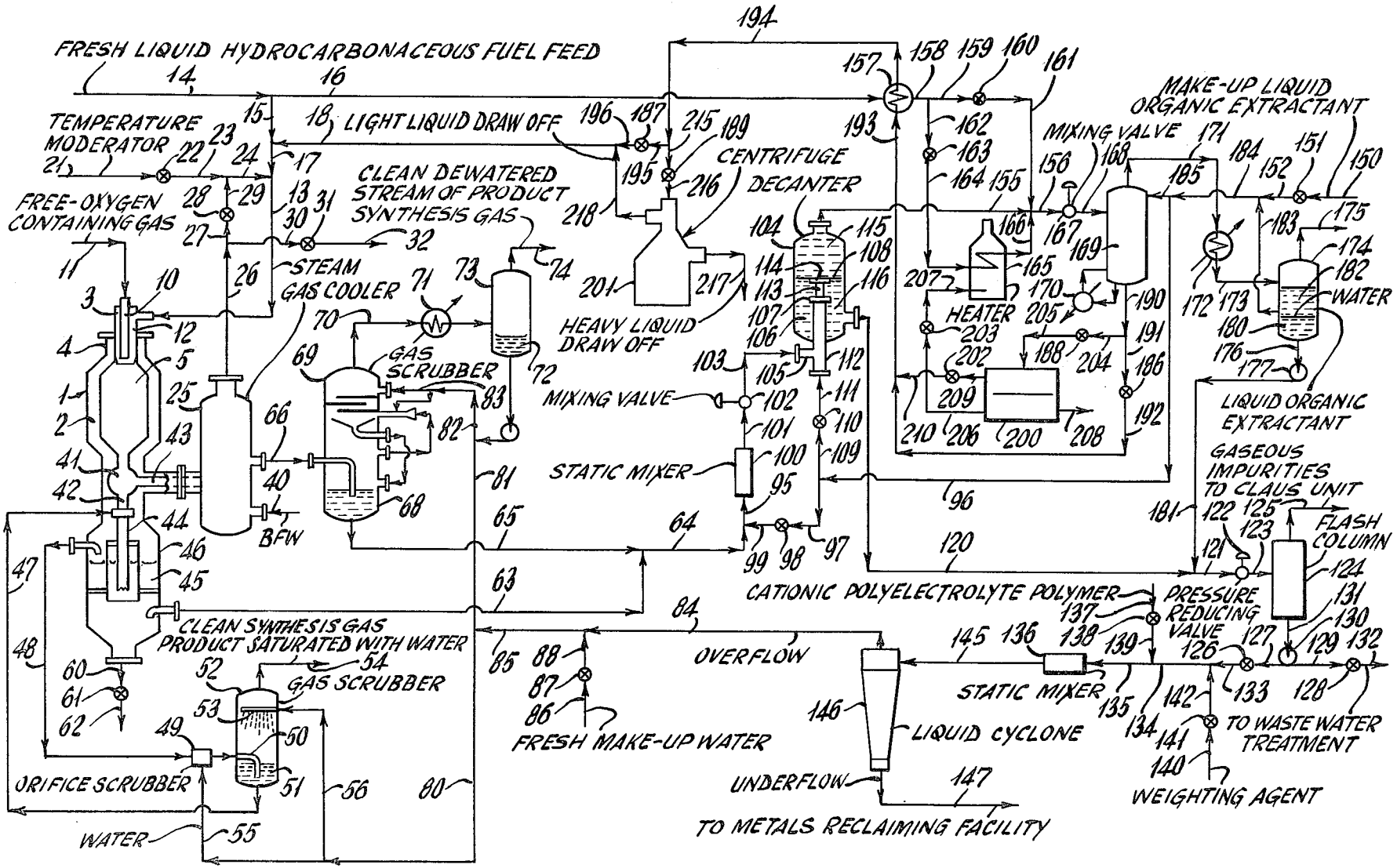
FRESH LIQUID HYDROCARBONACEOUS FUEL FEED
TEMPERATURE MODERATOR
FREE-OXYGEN CONTAINING GAS
LIGHT LIQUID DRAW OFF
CLEAN DEWATERED STREAM OF PRODUCT SYNTHESIS GAS
STEAM
GAS COOLER
GAS SCRUBBER
BFW
CLEAN SYNTHESIS GAS PRODUCT SATURATED WITH WATER
GAS SCRUBBER
ORIFICE SCRUBBER
WATER
HEAVY LIQUID DRAW OFF
CENTRIFUGE DECANTER
MIXING VALVE
STATIC MIXER
CATIONIC POLYELECTROLYTE POLYMER
OVERFLOW
FRESH MAKE-UP WATER
UNDERFLOW
TO METALS RECLAIMING FACILITY
LIQUID CYCLONE
STATIC MIXER
HEATER
MIXING VALVE
MAKE-UP LIQUID ORGANIC EXTRACTANT
WATER
LIQUID ORGANIC EXTRACTANT
GASEOUS IMPURITIES TO CLAUS UNIT
FLASH COLUMN
PRESSURE REDUCING VALVE
TO WASTE WATER TREATMENT
WEIGHTING AGENT

PARTIAL OXIDATION PROCESS

BACKGROUND OF THE INVENTION

This invention relates to the partial oxidation of metals-containing hydrocarbonaceous fuels for the production of synthesis gas, fuel gas, or reducing gas. More specifically, it relates to the noncatalytic partial oxidation of liquid hydrocarbonaceous fuels with total recycle of the unconverted particulate carbon and without build-up in the system of the metals normally present in the fresh hydrocarbonaceous fuel feedstock.

Hydrocarbonaceous fuels, such as crude oil contain inorganic and organic compounds of iron, nickel and vanadium. During the partial oxidation reaction, unless prevented these compounds could react with the refractory lining of the reaction zone in the gas generator. However, by removing the metals such reactions are prevented. Thus, the generator is operated so that a portion of the carbon in the fuel passes through the reaction zone as unconverted particulate carbon. This particulate carbon sequesters the metals and leaves the reaction zone as soot entrained in the raw effluent gas stream. The unconverted particulate carbon with the associated metals and metal compounds is recovered and may be recycled to the gas generator as a portion of the reactant fuel feed. While this improves fuel efficiency, the metals in the system may also build up and under certain conditions contribute to problems downstream in the system such as by forming deposits in heat exchangers and other equipment that may plug passages and/or foul tubes.

By the subject process, there is a reduction of about 50 wt.% of the metals and metal compounds that are recycled to the gas generator. This may extend the life of the equipment, increase the efficiency of the process, and yield valuable by-product materials rich in nickel and vanadium.

Entrained particulate carbon may be removed from the raw effluent gas by quenching and scrubbing with water such as described in coassigned U.S. Pat. Nos. 3,069,251 and 3,232,728. Recovery of the particulate carbon from carbon-water dispersions by the steps of adding a light oil to the carbon-water dispersion, separating water and light oil-carbon dispersion in a decanter, mixing the light oil-carbon dispersion with heavy oil and heating in a preheater, and vaporizing the light oil in a flash drum or distillation tower is described respectively in coassigned U.S. Pat. Nos. 2,999,741; 2,992,906; 3,044,179; and 4,134,740. Typical decanting procedures are described in coassigned U.S. Pat. Nos. 3,980,592 and 4,014,786.

The carbon-recovery zone in prior-art systems was operated in such a manner that a large amount of the ash in the mixture of soot-water dispersion and liquid organic extractant entering the decanter was transferred along with the soot to the liquid organic extractant layer that separates out in the decanter along with a separate water layer. However, with total soot recycle excessive metals build-up in the system may occur. Further, nickel and iron carbonyls may form from the suspended metals in the grey water. Under certain conditions such metal carbonyls may decompose or form insoluble compounds that might foul surfaces or plug equipment.

In contrast, by the subject process which includes recycling about 80–100 wt.% of the particulate carbon and soot produced, a significantly large portion of the ash in the soot-water feedstream entering the decanter is transferred to the grey water layer that separates out in the decanter and may be thereby easily removed from the system. By this means, the aforesaid problems are substantially reduced or eliminated.

SUMMARY OF THE INVENTION

In a partial oxidation system using a liquid hydrocarbonaceous fuel feedstock containing iron, nickel and vanadium compounds and in which at least about 85 to 100 wt.% and preferably all of the carbon-soot entrained in the gas stream leaving the gas generator is recovered and recycled to the gas generator as a portion of the reactant fuel feedstock, by means of the subject method the metals and metal compounds i.e., ash in the soot-water feed to the decanter are unexpectedly concentrated to a high degree and become suspended in the grey water that separates out in the decanter in the carbon recovery system. These metals and metal compounds may be then easily removed from the system along with the grey water. In the process, the stream of soot-water dispersion from the gas quench cooling and/or scrubbing zones and the the stream of liquid organic extractant are passed through an in-line static mixer under conditions of gentle non-turbulent mixing. The mixture is then passed through a mixing valve which promotes highly turbulent mixing. Gravity settling then takes place in the decanter. From about 40–90 wt.% such as 70–85 wt.% of the metals and metal compounds i.e., ash in the soot-water feedstream to the decanter become suspended in the grey water that collects at the bottom section of the decanter. A carbon-soot liquid organic extractant dispersion containing the remainder of the ash floats on the grey-water in the upper section of the decanter.

In one embodiment, about 85 to 100 wt.% of the metals suspended in the grey water are separated from the grey water. The de-ashed grey water is then recycled to the gas scrubbing and/or quenching zones. A conventional solids-liquid separator may be used to remove the metals from the grey water. For example, a liquid cyclone, centrifuge, gravity thickener or clarifier, filter, or combinations thereof with or without addition of a high molecular weight cationic polyelectrolyte polymer and with or without a weighting agent such as bentonite clay or bauxite may be used.

The carbon-soot-liquid organic extractant dispersion from the decanter is resolved by adding liquid hydrocarbonaceous fuel and vaporizing the liquid organic extractant in a still. All of the unbound ash becomes suspended in the still bottoms. Optionally at least a portion of the ash may be removed from the still bottoms. For example, about 26 to 52 wt.%, or more of the ash suspended in the carbon-soot-liquid hydrocarbonaceous dispersion from the bottom of the liquid organic extractant vaporizing zone i.e., still may be removed from that portion of the dispersion which is recycled to the gas generator as a portion of the reactant fuel by means of solids-liquid hydrocarbonaceous fuel separation such as by elevated temperature settling, centrifuging, filtration, or combinations thereof.

By the subject process, build-up in the system of the metals and metal compounds i.e. ash from the hydrocarbonaceous fuel and their subsequent depositing out in downstream equipment is prevented.

BRIEF DESCRIPTION OF THE DRAWING

The invention will be further understood by reference to the accompanying drawing. The drawing is schematic representation of a preferred embodiment of the process.

DESCRIPTION OF THE INVENTION

In the subject continuous process, a raw gas stream substantially comprising $H_2$, CO, $H_2O$ and at least one gas from the group $CO_2$, $H_2S$, COS, $CH_4$, $N_2$, Ar, and containing entrained carbon-soot is produced by partial oxidation of a liquid hydrocarbonaceous fuel with a free-oxygen containing gas, in the presence of a temperature moderator, in the reaction zone of an unpacked free-flow noncatalytic partial-oxidation gas generator. The feed to the gas generator comprises about 15–85 wt.%, such as about 30–60 wt.% of fresh liquid hydrocarbonaceous fuel and the remainder comprises a recycle dispersion of liquid hydrocarbonaceous fuel, soot, and particulate carbon from recycled soot which has been previously demetallized or deashed in the manner to be described. A burner such as shown in coassigned U.S. Pat. No. 2,928,460, which is incorporated herein by reference, may be used to introduce the feedstream into the reaction zone.

The atomic ratio of free oxygen to carbon in the fuel (O/C ratio), is in the range of 0.6 to 1.6, and preferably about 0.7 to 1.5. The reaction time is in the range of about 1 to 10 seconds, and preferably about 2 to 6 seconds. When steam is used as the temperature moderator, the steam-to-fuel weight ratio in the reaction zone is in the range of about 0.1 to 5, and preferably about 0.2 to 0.7.

The term "liquid hydrocarbonaceous" fuel as used herein to describe suitable feedstocks is intended to include various materials, such as crude oil, crude residue, vacuum resid, heavy distillate from crude oil, asphalt, residual fuel oil, deasphalted bottoms oil, tar-sand and shale oil, coal derived oil, and oil from coal liquefaction.

At least one of the metal compounds from the group of metal compounds comprising iron, nickel, and vanadium compounds are present in the fresh hydrocarbonaceous fuel. The metal compounds are in the form of inorganic or organo-metallic compounds. Each metal may be present in the range of about 3.0 to 3300 parts per million (ppm), or higher.

The term free oxygen containing gas, as used herein, is intended to include air, oxygen-enriched air, i.e. greater than 20 mole % oxygen, and substantially pure oxygen i.e. greater than 95 mole % oxygen (the remainder comprising $N_2$ and rare gases). Free-oxygen containing gas may be introduced into the burner at a temperature in the range of about ambient to 1200° F.

The hydrocarbonaceous feed may be at room temperature or it may be preheated to a temperature up to as high as about 600° to 1200° F., but preferably below its cracking temperature. The hydrocarbonaceous feed may be introduced into the burner in liquid phase or in a vaporized mixture with a temperature moderator.

The temperature moderator may be introduced into the synthesis gas generator in admixture with either or both reactant streams. Alternatively, the temperature moderator may be introduced into the reaction zone of the gas generator by way of a separate conduit in the fuel burner. Suitable temperature moderators include $H_2O$, $CO_2$-rich gas, cooled clean synthesis gas from the gas generator, by-product nitrogen from the air separation unit to be further described, and mixtures of the aforesaid temperature moderators.

The raw gas stream exits from the reaction zone at a temperature in the range of about 1700° to 3500° F., and preferably 2000° to 2800° F., and at a pressure in the range of about 1 to 300 atmospheres, and preferably 15 to 150 atmospheres.

The composition of the raw gas stream leaving the gas generator is about as follows, in mole percent; $H_2$ 10 to 70, CO 15 to 57, $CO_2$ 0.1 to 25, $H_2O$ 0.1 to 20, $CH_4$ nil to 60, $H_2S$ nil to 2, COS nil to 0.1, $N_2$ nil to 60, and Ar, nil to 2.0. Soot is present in the range of about 0.2 to 20 wt.% such as 0.5 to 2 wt.% (basis carbon content in the original feed). Ash is present in the soot in the amount of about 1.0 to 30 wt.%, such as about 3.0 to 20 wt.% (basis wt. of soot). By definition, soot comprises particulate carbon plus ash; and, the ash comprises the water insoluble metals, and metal sulfides that may be produced in the gas generator from the metal constituents in the hydrocarbonaceous fuel. In the reaction zone, these metals and metal compounds may be sequestered by the unconverted particulate carbon thus preventing attack of the refractory lining of the gas generator. Generally, ash is comprised of the metals and metal sulfides selected from the group consisting of Fe, Ni, V and mixtures thereof. Depending on the composition, the gas stream may be employed as synthesis gas, reducing gas, or fuel gas, with or without further cleaning, adjustment of the $H_2$/CO ratio, or purification.

The gas generator comprises a vertical free-flow cylindrically shaped steel pressure vessel lined with refractory, such as shown in coassigned U.S. Pat. No. 2,818,326. There is no obstruction to the free flow of the reaction products passing through the gas generator. The hot effluent gas stream leaving the gas generator may be optionally passed through a free-flow catch pot.

All of the hot effluent gas stream may be cooled by direct quenching in water, or by indirect heat exchange with water in a gas cooler. Alternatively, as provided herein, the hot effluent gas stream may be split into two separate gas steams. One split-stream is then quench cooled and scrubbed in water in a quench tank. A product gas stream is thereby produced saturated with water. The other split-stream is cooled in a gas cooler and scrubbed with water in a gas scrubbing zone and cooled below the dew point. A dewatered product gas stream is thereby produced.

Thus, the effluent gas stream from the partial oxidation gas generator may be cooled to a temperature in the range of about 350° to 750° F. but above the dew point of water by indirect heat exchange with water in a gas cooler, such as shown and described in coassigned U.S. Pat. No. 3,709,669, which is incorporated herein by reference. By this means by-product steam for use elsewhere in the process may be produced. The cooled process gas stream is then cleaned by scrubbing with water in a conventional gas scrubbing zone. For example, a venturi or jet scrubber or gas scrubber may be used. By this means clean product gas and a dispersion of soot in water may be produced.

Alternatively, as shown in coassigned U.S. Pat. No. 2,818,326 which is incorporated herein by reference, the hot effluent stream of gas from the reaction zone may be cooled to a temperature in the range of about 180° to 600° F. by direct contact with water in a quench tank. At least a portion of the entrained solids is thereby removed from the process gas stream by the turbulent quench water. Any remaining entrained solids may be removed from the process gas stream by additional scrubbing with water in the gas scrubbing zone at a temperature in the range of about 100° to 600° F., and a pressure in the range of about 1–300 atmospheres. Suitably the pressure in the scrubbing zone is about the same as that in the gas generator, less ordinary pressure drop in the line. A pumpable dispersion of soot and water in which the soot is present in the range of about 0.05 to 3.0 wt.% such as about 0.5 to 1.0 wt.%,, and preferably below about 1.5 wt.% are produced in the quench tank and scrubbing zone.

It is economically expedient in the subject process to resolve the soot-water dispersion from the quench and scrubbing operations and to recycle the components. Thus, clarified water may be recycled to the gas quench cooling and/or scrubbing operation(s). The soot may be recovered as a carbon-soot-liquid hydrocarbonaceous fuel slurry and recycled to the gas generator as a portion of the hydrocarbonaceous feed, or to an oil-fired heater as a fuel. By this means, there may be no net production of carbon. This may be done by mixing sufficient liquid organic extractant at a temperature in the range of about 100° to 350° F. and preferably 180° to 250° F. with the soot-water dispersion at a temperature in the range of about 200° to 550° F. and preferably 250° to 400° F. in a two-stage decanting operation, such as described in coassigned U.S. Pat. No. 4,038,186, which is incorporated herein by reference.

In a two-stage decanter two feedstreams are simultaneously introduced into the decanter, such as shown in FIG. 1 of coassigned U.S. Pat. No. 4,038,186. About 3–25 wt.% of the liquid organic extractant is mixed with all of the soot-water dispersion to comprise the first feedstream in which the weight ratio of liquid organic extractant to soot is in the range of about 2 to 10, such as about 3 to 8. The remainder of the liquid organic extractant comprises the second feedstream.

For example, sufficient liquid organic extractant is mixed with the soot-water dispersion in the first stage to release the particulate carbon. This may range between about 1.5–15 lbs. of liquid organic extractant per lb. of particulate carbon in the soot. Simultaneously, the remainder of the liquid organic extractant i.e., about 75 to 97 wt.% of the total is introduced into the second stage of the decanter. A dispersion of carbon-soot in liquid organic extractant together with small amounts of water is continuously removed from the top of the decanter. This dispersion comprises about 0.5 to 9 wt.% carbon-soot such as about and preferably 0.5 to 5 wt.% soot, less than about 5 weight % water, and the remainder liquid organic extractant.

Suitable liquid organic extractants that form dispersions with soot which are lighter than water include: (1) light liquid hydrocarbon fuels having an atmospheric boiling point in the range of about 100° to 750° F., degrees API in the range of over 20 to about 100, and a carbon number in the range of about 5 to 16; (2) a mixture of liquid organic by-products from an oxo or oxyl process; and (3) mixtures of types (1) and (2). Examples of type (1) liquid extractants include butanes, pentanes, hexanes, toluene, benzene, xylene, gasoline, naphtha, gas oil, their mixtures and the like. Naphtha is the preferred liquid organic extractant.

The decanter operates at a temperature in the range of about 180° to 550° F. and preferably above 250° F. The pressure in the decanter is basically set by the temperature. The pressure must be at least high enough to keep the liquid organic extractant and the water from vaporizing in the decanter. The maximum pressure in the decanter may be about the same as that in the gas generator less ordinary pressure drop in the lines. Suitably, the pressure may be in the range of about 150–1000 psig. The residue time in the decanter may be in the range of about 2 to 20 minutes, such as about 5 to 15 minutes.

In order to separate the carbon-soot from the liquid extractant, the carbon-soot-liquid organic extractant overhead dispersion leaving the decanter is mixed with a heavy extraction oil. In the subject process, this extraction oil comprises a portion of the fresh hydrocarbonaceous fuel feed. Then in a vaporizing zone, such as a still, the comparatively light liquid organic extractant is vaporized and removed overhead for recycle to the decanter and/or the still as reflux. A pumpable slurry of hydrocarbonaceous fuel containing carbon-soot in the amount of about 0.5 to 25.0 wt.%, such as about 1.0 to 8.0 wt.% is then removed from the bottom of the vaporizing zone or still at a temperature in the range of about 180° F. to 700° F., such as about 200° F. to 550° F. for recycle to the gas generator as a portion of the feed.

In the subject process, at least a portion, i.e. about 80–100 wt.% of the carbon-soot-liquid hydrocarbonaceous fuel slurry is recycled to the gas generator in admixture with the fresh liquid hydrocarbonaceous fuel feed. At least a portion of the ash in the recycled soot in said slurry becomes unbound during its second trip through the reaction zone of the gas generator. Further, substantially all of the metal constituents present in the fresh liquid hydrocarbonaceous fuel will be sequestered by unconverted particulate carbon upon passing through the reaction zone for the first time to form new soot. The raw gas stream is then quench cooled or scrubbed with water and the entrained soot is removed as a soot-water dispersion. The unbound ash and particulate carbon are also present in the soot-water dispersion. By means of the subject process, substantially more ash in the soot-water feedstream entering the decanter than previously is transferred to the grey water layer that separates out in the decanter. The ash may be thereby easily removed from the system. Substantially all of the particulate carbon and the remaining soot and any remaining ash is transferred to the liquid organic extractant layer.

The mixing operation prior to entering the decanter provides the necessary contacting of the soot-water dispersion with the liquid organic extractant in order to extract the soot from the water and to separate ash from particulate carbon in the soot. Insufficient contacting does not clean the water. In the subject process, it was unexpectedly found that the combination of the gentle non-turbulent mixing provided by an in-line static mixer followed directly by the severe turbulent mixing provided by a globe-type mixing valve would transfer to the grey water that separates out in the decanter about 40–90 wt.%, such as about 70–85 wt.%, or more, of the total ash present in the decanter feed. Further, substantially all of the remaining soot comprising particulate carbon and bound ash and the particulate carbon remaining after the ash is released from a portion of the soot by means of the mixing valve is transferred to the liquid organic extractant. By this distribution, ash removal from the system may be simplified.

A conventional in-line static mixer is used in the first stage of the two stage mixing operation. The stream of soot-water dispersion and the stream of liquid organic extractant are simultaneously passed through the in-line static mixer. Gentle non-turbulent mixing together of the two streams is thereby brought about by the static mixer. The static mixer comprises from about 2 to 24, such as 6–18, standard elements. The pressure drop across the static mixer may be less than about 10 kilo pascals.

The static mixer is a device for thoroughly mixing together a plurality of fluids, such as 2, while simultaneously conveying them in the same longitudinal direction. The static mixer comprises a free-flow cylindrical conduit and a plurality of fixed helical-shaped curved sheet-like elements which extend longitudinally one after the other in series. The elements are enclosed longitudinally throughout the length of the tubular conduit for use in turning the direction of the fluids being mixed together therein. Each element extends to the conduit walls and divides the conduit on the inside into separated channels. Flow division and radial mixing occur simultaneously within the conduit. There are no moving parts in this mixer and it has no external power requirements. A suitable static mixer may be obtained from Kenics Corporation, Danvers, Mass. 01923.

A conventional globe-type mix valve capable of promoting severe turbulent mixing is used directly downstream from the static mixer in the second stage of the two step mixing operation. The mix valve is adjusted to produce a pressure drop across the valve in the range of about 40 to 500 kilo pascals (kPa), such as about 150 to 250 kPa.

By the aforesaid sequential mixing operation the grey water leaves from the bottom of the decanter containing from about 70 to 90 wt.%, such as 75 to 85 wt.% of the suspended unbound ash. This dilute grey water dispersion leaves the decanter at a temperature in the range of about 180° to 550° F., such as about 250° to 350° F. and at a pressure of about 150 to 1000 psig, such as about 250 to 300 psig., and high enough to avoid boiling. A portion of any gaseous impurities, such as $H_2S$, COS, $NH_3$, gaseous hydrocarbons and HCN in the grey water may be then removed in a flash-tower.

Thus, the grey water ash dispersion leaves from the bottom of the decanter and is passed through a pressure reducing valve and into a flash-tower. The pressure is dropped to about 0 to 30 psig; and, for example, up to 10 wt.%, say about 1–7 wt.% of the water is flashed into steam. The dissolved gaseous materials flash-off from the grey water and are separated therefrom in the flash-tower. The grey water-ash dispersion leaves from the bottom of the flash-tower at a temperature for example in the range of about 212° to 275° F. containing suspended ash in an amount in the range of about 0.02 to 1.2 wt.% such as about 0.03 to 0.80 wt.% depending on the ash content of the feed and the unconverted carbon level.

Optionally, a portion of the degassed grey water from the flash tower, i.e. 0 to 20 wt.%, such as about 5 to 10 wt.% is sent to a conventional waste water treatment facility where upgraded water is produced. A suitable waste water process is described in coassigned U.S. Pat. No. 4,211,646, which is incorporated herein by reference.

Preferably, at least a portion, i.e. 80 to 100 wt.% of the degassed grey water in introduced into at least one solids-liquid concentrator where from about 80 to 100 wt.%, such as about 85–95 wt.%, of the insoluble ash is removed. A de-ashed stream of grey water is then recycled to the gas quench cooling and/or scrubbing operations. Any remaining degassed grey water may be then sent to the waste water treatment facility.

The solids-liquid separator may be at least one conventional liquid cyclone, centrifuge, gravity thickener or clarifier, filter, or combinations thereof. Two or more solids-liquid separators may be connected in parallel, or in series. Suitable solids-liquid separators and operating conditions are shown and described in the Chemical Engineer's Handbook, Perry and Chilton, Fifth Edition, McGraw Hill Book Co., N.Y. For example, centrifuges are described on pages 19–87 to 101; gravity sedimentation by means of thickeners and clarifiers is described on pages 19–44 to 19–57; filtration is described on pages 19–56 to 19–87; and liquid cyclones are described on pages 20–81 to 20–85.

Liquid cyclones are also referred to as hydroclones and are preferred for continuous operation. Liquid cyclones use pressure energy to create rotational motion in a body of liquid flowing continuously through the cyclone separator. The liquid cyclone separator has a tangential feed inlet in the cylindrical shaped upper portion, and, it has a conical shaped lower portion that discharges through a central bottom outlet at the apex of the cone. The velocity of the downflowing liquid feed creates a vortex action of rapidly rotating liquid that spins about the axis of the cone and which is forced inward, upward and out through a centrally located overflow outlet at the top of the separator. The larger heavier particles of solid matter are thrown outward against the wall of the cone by the centrifugal force within the vortex. The heavier solid particles exit with the underflow through the bottom outlet. Smaller solid particles may remain in the dilute overflow that is discharged through the central top outlet. Suitable liquid cyclones may be obtained from Dorr-Oliver, Stamford, Conn.

In another embodiment, the content of insoluble metals and metal compounds suspended in the grey water is decreased and the metals are recovered for their value. A conventional solids-liquid separator is used such as a liquid cyclone, with or without the addition of a high molecular weight cationic polyelectrolyte polymer, or bentonite plus said polymer. The extremely small particulate solids i.e. about 3 microns or less are present as at least one metal from the group consisting of Fe, Ni, V, and the sulfides thereof in water. For example they may represent an ore concentrate comprising in wt.% iron 15–25, such as about 20, nickel 15–25, such as about 20, and vanadium 50–70, such as about 60. Such a by-product may be of considerable value. Alternatively, nickel may be recovered from the ore concentrate. For example, by treating sulfur-free ore concentrate with a portion of the CO in the product synthesis gas at low pressure, i.e. 1–3 atmospheres and at a temperature in the range of about 100° F. to 210° F., nickel carbonyl gas may be produced. The nickel carbonyl may be then decomposed at a temperature in the range of about 325° to 575° F. to give pure nickel and carbon monoxide.

The electrophoretic mobility of the ash particles in the grey water was measured and the zeta potential was calculated to be about −40 millivolts. This indicated that the particles were highly negatively charged and that a cationic polyelectrolyte polymer was needed to settle the solids found in the grey water. A cationic polyelectrolyte polymer having a high molecular weight in the range of about 0.5 to $10\times10^6$, such as 3 to $5\times10^6$, a Flash Point (closed cup) about 200° F.; and a Specific Gravity (73° F.) of 8.55 lbs per gallon was found to decrease the settling rate of the suspended solids. Dosages of the polymer were in the amount of 10–50 ppm. Even faster settling of the solids was achieved by the addition of 50–100 ppm of a weight, such as about 60–80 ppm of bentonite clay, i.e. colloidal clay or bauxite, or other insoluble relatively dense powdered mineral to the grey water along with the polyelectrolyte polymer. Thus, the bentonite clay is trapped in the cationic polymeric floc and acts as a weighting agent by providing the floc with sufficient density to settle rapidly or to be effectively removed by a "hydroclone". An in-line static mixer or a separate mixer and mixing tank may be used to mix the flocculant/coagulant and the weighting agent with the grey water.

Typical cationic polyelectrolyte flocculants include: polyalkylene-polyamine, polyepichloro-hydrin, polyethylenimine, polyaminoethyl-polyacrylamide, polyvinylbenzyl-trimethyl-ammonium chloride and polydimethyl-diallyl-ammonium chloride.

EXAMPLE I

The effect of the addition of a flocculant/coagulant on the settling of metals suspended in grey water is demonstrated by this example. The test results are shown in Table I below.

The metal analysis of untreated grey water is shown in columns 1 and 2 below. After 24 hours settling, the analysis of the supernatant fluid for the untreated sample of grey water is shown in column 3. In a second sample, the grey water was treated with 100 ppm of bentonite clay and followed by 10 ppm of high molecular weight cationic polyelectrolyte polymer Betz Polymer 1165L, a product of Betz Laboratories Inc. Trevose, Pa. After 1 minute, the analysis for the supernatant fluid for the treated sample of grey water is shown in column 4. The data in Table I shows the definite improved effect of the addition of a flocculant/coagulant on the settling of the metals nickel, iron and vanadium in the grey water.

TABLE I

SUSPENDED METALS IN GREY WATER

| Metal | Untreated Sample mg/L | Untreated Sample After 24 Hrs Settling mg/L | Treated Sample After 1 minute Settling mg/L |
|---|---|---|---|
| Nickel | 48.7 | 0.03 | 0.13 |
| Iron | 14.31 | 0.01 | 0.07 |
| Vanadium | 208.3 | 0.01 | 0.10 |

Regarding a preferred embodiment, the carbon-soot-liquid hydrocarbonaceous fuel slurry from the bottom of the liquid organic extractant recovery still and with or without cooling is passed through a solids-liquid separator to remove about 26–52 wt.% or more of the suspended ash. The solids-liquid separator may be a thermally insulated or heated settling tank. Settling conditions may be from about 1 hour to 5 days at a temperature in the range of about 250° F. to 650° F., such as about 8 hours at 350° F.

The heavier ash containing fraction will settle to the bottom of the tank and may be withdrawn from time to time for some other use. Substantially all of the suspended ash particles in the size range of greater than about 5 microns will settle out. A portion of the bottoms may be used as a fuel in a heater to preheat the fresh liquid hydrocarbonaceous fuel feed going into the liquid organic extractant still. A second portion may be exported as a fuel. The de-ashed slurry is removed periodically from the top of the settling tank and at least a portion i.e. about 75 to 100 wt.% may be recycled to the gas generator as a portion of the feedstock. Results of elevated temperature settling of ash suspended in a recycle feed slurry are shown in Example II. Improved settling will result as the temperature and time of settling is increased.

EXAMPLE II

A sample of carbon-soot-liquid hydrocarbonaceous fuel slurry containing about 1.5–2.0 wt.% of carbon-soot was allowed to settle for five days at a temperature of 350° F. The data in Table II shows that by settling at elevated temperature the metals suspended in the slurry may be reduced in the range of about 26 to 39%.

TABLE II

ELEVATED TEMPERATURE SETTLING OF METALS

| | Metal, total | | |
|---|---|---|---|
| | Ni | V | Fe |
| Original, ppm | 233 | 715 | 109 |
| 3" from top | 142 | 510 | 81 |
| Bottom | 264 | 1006 | 215 |
| % Reduction | 39 | 29 | 26 |

Alternatively, a centrifuge such as described previously, may be used as the solids-liquid hydrocarbonaceous fuel separator at a temperature in the range of about ambient to 350° F., such as about 125° to 250° F. When necessary, the carbon-soot-liquid hydrocarbonaceous fuel slurry may be cooled to the proper temperature for centrifuging by indirect heat exchange with fresh liquid hydrocarbonaceous fuel feed.

Speeds may be in the range of about 1,000 to 50,000 revolutions per minute (rpm). The maximum centrifugal force×gravity may be in the range of about 770 to 62,000, such as about 5500 to 13,600 times gravity. Results of elevated temperature centrifuging of a recycle feed slurry are shown in Example III.

EXAMPLE III

A sampe of carbon-soot-liquid hydrocarbonaceous fuel slurry containing about 1.5–2.0 wt.% carbon-soot was centrifuged once and then again at a temperature of 150° F. by means of a centrifuge rotating at a speed up to 40,000 rpm. The data in Table III shows that by centrifuging at elevated temperature, the metals suspended in the slurry may be reduced in the range of about 40 to 52 wt.%.

TABLE III

ELEVATED TEMPERATURE CENTRIFUGING

| | Metal, total | | |
|---|---|---|---|
| | V | Ni | Fe |
| Original, ppm | 754 | 395 | 224 |
| Centrifuged once | 535 | 200 | 131 |
| Centrifuged twice | 451 | 188 | 120 |
| % Reduction | 40 | 52 | 51 |

DESCRIPTION OF THE DRAWING

A more complete understanding of the invention may be had by reference to the accompanying drawing which illustrates a preferred embodiment of the invention.

Although the drawing illustrates a preferred embodiment of the invention, it is not intended to limit the subject invention to the particular apparatus or materials described.

Gas generator 1 is a vertical cylindrically shaped unpacked free-flow non-catalytic steel pressure vessel lined with refractory 2. Annulus-type burner 3 is mounted in upper inlet 4 for introducing the reactant feedstreams into reaction zone 5.

Burner 3 includes central passage 10, through which a stream of free-oxygen containing gas from line 11 is introduced, and annular passage 12 through which a mixture of hydrocarbonaceous fuel and steam from line 13 is introduced. Fresh liquid hydrocarbonaceous fuel feed in line 14 is passed through lines 15 and 16. In lines 17, the fresh liquid hydrocarbonaceous fuel is mixed with a recycled carbon-soot-liquid hydrocarbonaceous slurry stream from line 18. This fuel feed mixture is mixed in line 13 with a temperature moderator from lines 21, valve 22, and lines 23–24 and/or steam from gas cooler 25 by way of lines 26–27, valve 28, and lines 29–24. By-product steam may be passed through line 30, valve 31, and line 32 for use elsewhere in the system or for export. Fresh boiler feed water (BFW) enters gas cooler 25 through line 40.

The raw effluent gas stream from reaction zone 5 splits into two gas streams in chamber 41. The two gas streams in passages 42 and 43 are simultaneously and separately cooled, cleaned, and scrubbed with water to remove entrained soot. Thus, the hot gas stream in passage 42 is passed through dip-tube 44 and quenched in water 45 contained in the bottom of quench tank 46. A recycle stream of water is introduced into quench tank 46 via line 47.

The quenched gas leaves through line 48 and is scrubbed again in nozzle scrubber 49 before passing through dip-tube 50 into water 51 contained in the bottom of gas scrubber 52. The gas stream then passes up through shower 53 where it is contacted with water before leaving through line 54 at the top of gas scrubber 52 as a clean stream of product synthesis gas saturated with water.

Nozzle scrubber 49 and gas scrubber 53 may be fed with fresh or demetallized recycle water from lines 55 and 56 respectively.

When required waste material may be cleaned out from the bottom of quench tank 46 via line 60, valve 61, and line 62. A stream of soot-water dispersion from the bottom of quench tank 46 is passed through line 63 and mixed in line 64 with a stream of soot-water dispersion from line 65. The later stream of soot-water is obtained by scrubbing the second split stream of hot raw synthesis gas from line 43 with water after said gas stream is cooled by indirect heat exchange with BFW in gas cooler 25. Thus, the cooled stream of raw synthesis gas in line 66 is quenched and scrubbed with water 68 in conventional gas scrubber 69 and leaves through line 70 at the top. The gas stream is cooled below the dew point in gas cooler 71. Separation of water 72 takes place in separating tank 73, and a clean dewatered stream of product synthesis gas leaves through over head line 74.

Scrubbing water for gas scrubbers 52 and 69, may be provided through lines 80 and 81–83 respectively. The scrubbing water may comprise demetallized grey water from lines 84–85; fresh make-up water from line 86, valve 87, and lines 88 and 85; and mixtures thereof.

The soot-water dispersion in line 64 and a recycle portion of liquid organic extractant, such as naphtha, from lines 96–97, valve 98 and line 99 are passed through line 95 and in-line static mixer 100 where gentle non-turbulent mixing of the streams takes place. The mixture then passes directly through line 101 and mixing valve 102 where severe turbulent mixing takes place. The mixture of soot-water and naptha passes through line 103 into decanter 104 by way of inlet 105, an annular passage in conduit sub-assembly 106, and lower horizontal radial nozzle 107. The mixture is discharged below interface level 108. Simultaneously, the second stage naphtha is introduced below interface level 108 by way of line 109, valve 110, line 111, inlet 112, central conduit 113, and upper horizontal radial nozzle 114. During the two-stage mixing, soot separates from the water and forms a suspension with the liquid organic extractant. Simultaneously the ash separates from the soot and forms a suspension with the water. In the decanter, a dispersion of particulate carbon, soot and naphtha 115 forms in the upper portion of the decanter and floats on the suspension of unbound ash and grey water 116.

Unexpectedly, from about 70–90 wt.%, such as 75 to 85 wt.%, of the unbound metals and metal compounds are suspended in the grey water in the lower section of the decanter. At least a portion of this grey water is sent to a solids-liquid concentration zone where the metals and metal compounds may be removed from the system. Thus, the grey water and ash is passed through lines 120 and 121, pressure reducing valve 122, line 123, and flashed into flash column 124. Gaseous impurities leave through line 125 and are sent to a Claus unit.

The grey water from the bottom of flash column 124 is pumped through lines 131, 127, 133, 134 and mixed in line 135 and in-line static mixer 136 with cationic polyelectrolyte polymer from line 137, valve 138, and line 139. Optionally, a weighting agent such as bentonite may be also introduced through line 140, valve 141, and line 142. The grey water mixture is then passed through line 145 into liquid cyclone 146 where it is separated into an underflow stream rich in ash and a de-ashed overflow stream. The underflow stream leaves by line 147 and may be sent to a metals reclaiming facility or dried and sold as material rich in Fe, Ni, and V. The overflow is recycled to gas scrubbers 52 and 69 as described previously.

Alternatively, with valve 126 in line 127 closed and valve 128 in line 129 open, all of the degassed grey water is pumped by means of pump 130 through lines 131, 129, and 132 to a waste water treatment facility (not shown). In such case, the scrubbing water for gas scrubbers 52 and 69 may be supplied from the fresh make-up water in line 86, valve 87 and line 88.

In another embodiment, a portion of the metal constitutents or ash may be removed from the carbon-soot-liquid organic extractant layer that separates from the grey water in the decanter. This embodiment may be used with or without the previous embodiment in which a portion of the ash was removed from the grey water. Further, the two de-ashing embodiments may be operated simultaneously. Accordingly, the carbon-soot-naphtha dispersion 115 is passed through line 155 and mixed in line 156 with fresh liquid hydrocarbonaceous fuel from lines 14, 16, heat exchanger 157, lines 158, 159, valve 160, and line 161. If additional preheating is required, the liquid hydrocarbonaceous fuel in line 158 may be passed through line 162, valve 163, line 164, heater 165, and line 166. Intimate mixing is achieved with mixing valve 167, and the mixture is passed through line 168 into naphtha still 169 equipped with reboiler 170.

Naphtha is vaporized in still 169, separated from the mixture, and leaves through overhead line 171 along with a small amount of $H_2O$. This stream is cooled below the dew point in cooler 172. The liquid naphtha and water mixture is passed through line 173 and into separation vessel 174. Gaseous impurities are removed through overhead line 175 and sent to a Claus unit. Water 180 is removed from the bottom of vessel 174 by way of line 176, pump 177, and sent to flash column 124 by way of lines 181, 121 and 123. Naphtha 182 is removed from separation vessel 174 and recycled to decanter 104 by way of lines 183, 184 and line 96. A portion of the naphtha may be passed through the 185 and into still 169 as reflux. Make-up liquid organic extractant may be introduced into the system through line 150, valve 151 and line 152.

All of the carbon-soot-liquid hydrocarbonaceous fuel slurry from the bottom of the naphtha still may be recycled to gas generator 1 as a portion of the reactant fuel feed. Thus, by opening valves 186 and 187 and closing valves 188 and 189, the bottom slurry from the naphtha still may be passed through lines 190 to 196, 18 and into line 17 where it is mixed with fresh liquid hydrocarbonaceous feed from lines 14–15.

Preferably, a portion of the metal solids or ash is removed from the carbon-soot-liquid hydrocarbonaceous fuel slurry prior to its recycle to the gas generator. This may be done in either one or two separate thermally insulated solids-liquid separators i.e., elevated temperature gravity settler 200 and/or elevated temperature centrifuge 201.

Thus, settler 200 is used alone by closing valves 186 and 189 and opening valves 187, 188, 202 and 203. The hot slurry from the bottom of naphtha still 169 is then passed into settling rank 200 by way of line 190, 204 and 205. Concentrated slurry may be passed through lines 206 and 207 and into heater 165 as the fuel. Alternatively, at least a portion of the concentrated slurry may be sent to a metals reclaiming facility by way of line 208. The de-ashed slurry is removed through lines 209, 210 and recycled to the gas generator via lines 193–196, 18, 17 and 13.

When additional de-ashing of the slurry stream in line 194 is required, valve 187 is closed, valve 189 is opened, and the slurry is passed into centrifuge 201 by way of lines 215 and 216. Heavy liquid draw off from line 217 may be sent to a metals reclaiming facility or used as a fuel. The de-ashed light liquid draw-off in line 218 is introduced into gas generator 1 as a portion of the reactant fuel by way of lines 18, 17 and 13. Optionally, elevated temperature settler 200 may be by-passed. In such case, de-ashing of the slurry would be done soley in centrifuge 201. This may be done by opening valves 186 and 189 and closing valves 187 and 188.

The process of the invention has been described generally and by examples with reference to a hydrocarbonaceous fuel and gas streams of particular compositions for purposes of clarity and illustration only. It will be apparent to those skilled in the art from the foregoing that various modification of the process and materials disclosed herein can be made without departure from the spirit of the invention.

We claim:

1. In a process for the partial oxidation of a hydrocarbonaceous fuel, slurry of carbonaceous fuel, or mixtures thereof, said fuel containing metal impurities, with a free oxygen-containing gas in the reaction zone of a free-flow noncatalytic gas generator at a temperature in the range of about 1700° to 3500° F. and a pressure in the range of about 1 to 300 atmospheres in the presence of a temperature moderator to produce a raw gas stream comprising $H_2$, CO, $H_2O$ and at least one gas from the group $CO_2$, $N_2$, Ar, $H_2S$, $CH_4$ and COS, and containing entrained soot, particulate carbon and ash; and contacting the raw gas stream with water in quenching and/or scrubbing zones to produce a soot-water dispersion, the improved method for preventing the build-up of ash in the system comprising:

(1) simultaneously passing a stream of said soot-water dispersion and a stream of liquid organic extractant through an in-line static mixer thereby providing gentle non-turbulent mixing together of said streams;

(2) passing the mixture leaving (1) directly through a mixing valve while simultaneously dropping the pressure across the valve to produce a pressure drop in the range of about 40 to 500 kilo pascals (kpa) thereby providing severe turbulent mixing;

(3) introducing the mixture from (2) into a decanter with the simultaneous introduction of a separate stream of liquid organic extractant, and settling in separate layers a grey water-ash dispersion including about 70–85 wt. %, or more of the total ash present in the decanter feed and a particulate carbon-soot-liquid organic extractant dispersion including the remaining ash;

(4) separately removing each of said dispersions from the decanter;

(5) flashing off gaseous impurities from the grey water-ash dispersion from (4) in a degassing zone;

(6) introducing about 80 to 100 wt. % of the degassed grey water-ash dispersion from (5) into a solids-liquid separating zone comprising at least one solids-liquid separator selected from the group consisting of liquid cyclone, centrifuge, gravity thickener or clarifier, filter, and combinations thereof where at least a portion of the water-insoluble ash is removed to produce deashed grey-water;

(7) introducing any remaining degassed grey water-ash dispersion from (5) into a waste water treatment facility; and (8) introducing at least a portion of the deashed grey water from (6) directly into the gas quenching and/or scrubbing zones.

2. The process of claim 1 provided with the added step of introducing a flocculant/coagulant or a flocculant/coagulant and a weighting agent into the degassed dispersion prior to said solids-liquid separating zone in step (6).

3. The process of claim 1 provided with the step of processing the ash separated in said solids-liquid separating zone in a metals reclaiming facility to recover Fe, Ni, and V.

4. The process of claim 1 wherein said solids-liquid separating zone comprises two or more of said solids-liquid separators connected in parallel, or in series.

5. The process of claim 2 wherein said flocculant-/coagulant is a cationic polyelectrolyte polymer.

6. The process of claim 2 wherein said weighting agent is selected from the group consisting of bentonite clay and bauxite.

7. The process of claim 1 provided with the steps of (9) mixing said particulate carbon-soot-liquid organic extractant dispersion from (4) with fresh liquid hydrocarbonaceous fuel;

(10) introducing the mixture from (9) into a vaporizing zone, and separately removing therefrom an overhead stream of liquid organic extractant and a bottoms dispersion of carbon-soot-liquid hydrocarbonaceous fuel;

(11) removing in a solids-liquid separating zone a portion of the ash in the dispersion of carbon-soot-liquid hydrocarbonaceous fuel from (10); and

(12) introducing a portion of the deashed dispersion from (7) into said partial oxidation gas generator as a portion of the hydrocarbonaceous fuel slurry.

8. The process of claim 7 wherein the solids-liquid separating zone in (11) is selected from the group of solids-liquid separators consisting of a thermally insulated or heated setting tank, centrifuge, filter, or combinations thereof.

9. The process of claim 7 wherein the solids-liquid separating zone in (11) in a settling tank, and provided with the step of settling said dispersion of carbon-soot-liquid hydrocarbonaceous fuel by gravity at a temperature in the range of about 250° F. to 650° F. and for a period of 1 hour to 5 days, so as to form an upper layer comprising said deashed portion of the dispersion of carbon-soot-liquid hydrocarbonaceous fuel, and a lower layer comprising the remainder of the dispersion of carbon-soot-liquid hydrocarbonaceous fuel enriched with ash.

10. The process of claim 9 provided with the step of introducing the lower layer of said dispersion into a heater as the fuel, or into a metals recovery facility.

11. The process of claim 7 wherein the solids-liquid separating zone in (11) is a centrifuge, and provided with the step of centrifuging said dispersion of carbon-soot-liquid hydrocarbonaceous fuel at a temperature in the range of about ambient to 350° F. at a speed in the range of about 1,000 to 50,000 rpm, so as to form a light liquid draw off comprising said deashed portion of the dispersion of carbon-soot-liquid hydrocarbonaceous fuel, and a heavy liquid draw off portion enriched with ash.

12. The process of claim 11 provided with the step of introducing the heavy liquid draw off portion into a heater as the fuel, or into a metals recovery facility.

13. In a process for the partial oxidation of a hydrocarbonaceous fuel, slurry of carbonaceous fuel, or mixtures thereof, said fuel containing metal impurities, with a free oxygen-containing gas in the reaction zone of a free-flow noncatalytic gas generator at a temperature in the range of about 1700° to 3500° F. and a pressure in the range of about 1 to 300 atmospheres in the presence of a temperature moderator to produce a raw gas stream comprising $H_2$, CO, $H_2O$ and at least one gas from the group $CO_2$, $N_2$, Ar, $H_2S$, $CH_4$ and COS, and containing entrained soot, particulate carbon and ash; and contacting the raw gas stream with water in a quenching and/or scrubbing zone to produce a soot-water dispersion, the improved method for preventing the build-up of ash in the system comprising;

(1) simultaneously passing a stream of said soot-water dispersion and a stream of liquid organic extractant through an in-line static mixer to provide gentle non-turbulent mixing together of said streams;

(2) passing the mixture leaving (1) directly through a mixing valve while simultaneously dropping the pressure across the valve thereby providing severe turbulent mixing;

(3) introducing the mixture from (2) into a decanter with the simultaneous introduction of a separate stream of liquid organic extractant, and settling in separate layers a grey water-ash dispersion and a particulate carbon-soot-liquid organic extractant dispersion;

(4) flashing off gaseous impurities from the grey water-ash dispersion from step (3), removing at least a portion of the ash from the degassed dispersion in a solids-liquid separating zone, and recycling at least a portion of the deashed grey water to the gas quenching and/or scrubbing zones;

(5) mixing said particulate carbon-soot-liquid organic extractant dispersion from (3) with fresh liquid hydrocarbonaceous fuel;

(6) introducing the mixture from (5) into a vaporizing zone, and separately removing therefrom an overhead stream of liquid organic extractant and a bottoms dispersion of carbon-soot-liquid hydrocarbonaceous fuel;

(7) removing in a solids-liquid separating zone a portion of the ash in the dispersion of carbon-soot-liquid hydrocarbonaceous fuel from (6); and (8) introducing at least a portion of the deashed dispersion from (7) into said partial oxidation gas generator as a portion of the hydrocarbonaceous fuel slurry.

14. The process of claim 13 wherein the solids-liquid separating zone in step (4) comprises a solids-liquid separator selected from the group consisting of liquid cyclone, centrifuge, gravity thickener or clarifier, filter, or combinations thereof.

15. The process of claim 14 provided with the added step of introducing a flocculant/coagulant or a flocculant/coagulant and a weighting agent into the degassed dispersion prior to said solids-liquid separating zone in step (4).

16. The process of claim 15 wherein said flocculant-/coagulant is a cationic polyelectrolyte polymer.

17. The process of claim 19 wherein said weighting agent is selected from the group consisting of bentonite clay and bauxite.

18. The process of claim 13 provided with the step of processing the ash separated in said solids-liquid separating zones in steps (4) and/or (7) in a metals reclaiming facility to recover Fe, Ni, and V.

19. The process of claim 13 wherein the solids-liquid separating zone in (7) is selected from the group of solids-liquid separators consisting of a thermally insulated or heated settling tank, centrifuge, filter, or combinations thereof.

20. The process of claim 13 wherein the solids-liquid separating zone in (7) is a settling tank, and provided with the step of settling said dispersion of carbon-soot-liquid hydrocarbonaceous fuel by gravity at a temperature in the range of about 250° F. to 650° F. and for a period of 1 hour to 5 days, so as to form an upper layer comprising said deashed portion of the dispersion of carbon-soot-liquid hydrocarbonaceous fuel, and a lower layer comprising the remainder of the dispersion of carbon-soot-liquid hydrocarbonaceous fuel enriched with ash.

21. The process of claim 13 wherein the solids-liquid separating zone in (7) is a centrifuge, and provided with the step of centrifuging said dipersion of carbon-soot-liquid hydrocarbonaceous fuel at a temperature in the range of about ambient to 350° F. at a speed in the range of about 1,000 to 50,000 rpm., so as to form a light liquid draw off comprising said deashed portion of the dispersion of carbon-soot-liquid hydrocarbonaceous fuel, and a heavy liquid draw off portion enriched with ash.

22. The process of claim 21 provided with the step of introducing the heavy liquid draw off portion into a heater as the fuel, or into a metals recovery facility.

* * * * *

UNITED STATES PATENT AND TRADEMARK OFFICE

CERTIFICATE OF CORRECTION

PATENT NO. : 4,466,810

DATED : August 21, 1984

INVENTOR(S) : R. M. DILLE, G. N. RICHTER, L. E. ESTABROOK, J. P. ROHNER, H. A. RHODES.

It is certified that error appears in the above—identified patent and that said Letters Patent is hereby corrected as shown below:

Claim 7 step (12) line 2 - Change "(7)" to --(11)--

Claim 17 line 1 - Change "19" to --15--

Signed and Sealed this

*Thirteenth* Day of *May 1986*

[SEAL]

*Attest:*

DONALD J. QUIGG

*Attesting Officer*

*Commissioner of Patents and Trademarks*